US005533313A

United States Patent [19]

Pike et al.

[11] Patent Number: 5,533,313

[45] Date of Patent: Jul. 9, 1996

[54] ROOF TILE ANCHORING CLIP

[76] Inventors: Robert D. Pike, 999 NW. 53rd Ct., Ft. Lauderdale, Fla. 33309; David C. Struve, 2541 Calamondin Cir., Coconut Creek, Fla. 33063

[21] Appl. No.: 285,047

[22] Filed: Aug. 3, 1994

[51] Int. Cl.[6] ..... E04D 1/34

[52] U.S. Cl. ..... 52/712; 52/521; 52/547

[58] Field of Search ..... 52/521, 547, 712, 52/748, 748.1, 747.11, 746.11

[56] References Cited

U.S. PATENT DOCUMENTS

| | | | |
|---|---|---|---|
| 1,510,497 | 10/1924 | Keller | 52/547 |
| 1,544,392 | 6/1925 | Harward et al. | 52/547 |
| 1,566,415 | 12/1925 | Miller . | |
| 1,775,778 | 9/1930 | Papalas . | |
| 2,279,943 | 4/1942 | Hayes et al. | 52/547 |
| 2,325,124 | 7/1943 | Gardner | 52/521 |
| 3,903,670 | 9/1975 | Robinson, Jr. | 52/547 X |
| 4,182,090 | 1/1980 | Aarons . | |
| 4,314,433 | 2/1982 | Hulcombe | 52/521 |
| 4,914,885 | 4/1990 | Baker et al. . | |
| 5,074,093 | 12/1991 | Meadows . | |

*Primary Examiner*—Carl D. Friedman
*Assistant Examiner*—Christopher Todd Kent
*Attorney, Agent, or Firm*—Malin, Haley, DiMaggio & Crosby

[57] ABSTRACT

A roofing tile hurricane clip for preventing the nose of an overlapping tile from lifting in high winds. The invention comprises a clip body having a fastening end, a generally C-shaped end for engaging the lower side edge of an overlapping tile, and an arcuate mid-body portion therebetween. The clip fastening end may incorporate an elongated aperture for accommodating a conventional fastener therethrough for securing the clip to a roofing tile such that the clip is subject to adjustment for engaging overlapping roofing tile edge of somewhat varying sizes.

7 Claims, 5 Drawing Sheets

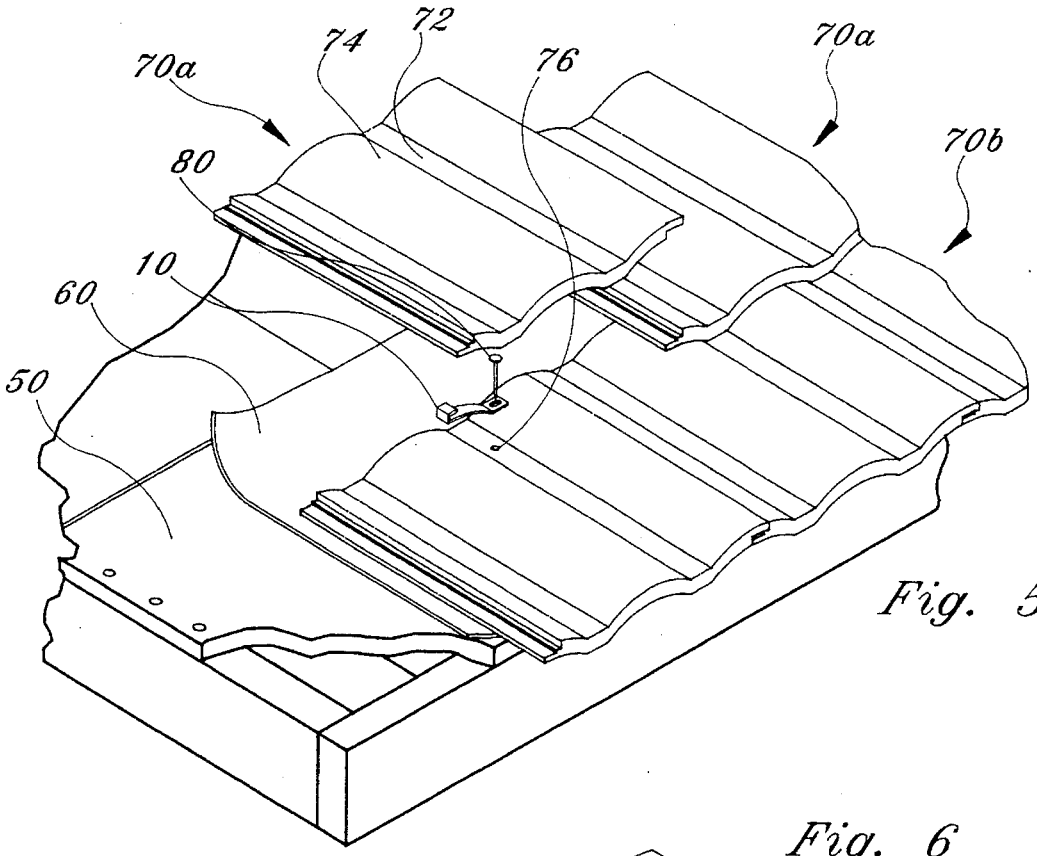
Fig. 5
Fig. 6
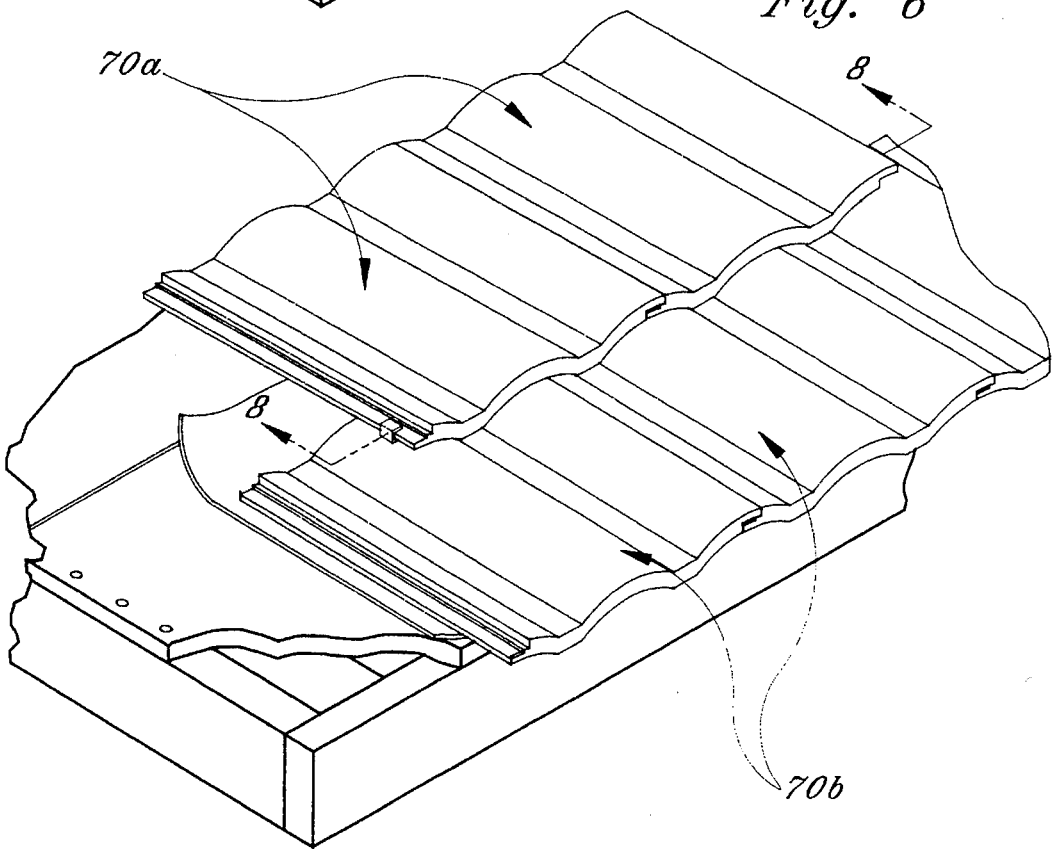

ROOF TILE ANCHORING CLIP

BACKGROUND OF THE INVENTION

1. Field of the Invention

The present invention relates to an improved roof tile fastening means, and more particularly to a roof tile clip for fastening roofing tile to a roof structure.

2. Description of the Prior Art

Typically, sloping roofs are constructed having a framework of rafters supporting a roof deck (sometimes called a "subroof"), which consists of sheathing and underlayment; the roof deck, in turn, provides a nailing base for the roof surface.

The type of roof deck used depends primarily on the nature of the roof surface material, however, most decks have both sheathing and underlayment. Sheathing is a material that provides the nailing base for the roof surface, and often consists of solid plywood sheathing comprising 4 by 8 foot panels nailed directly to the rafters. The underlayment is sandwiched between the sheathing and the roof surface and usually consists of one or more layers of roofing felt, a thick, fibrous mat that has been saturated and coated with asphalt. Areas subjected to heavy rain or hurricanes, such as the Southeast, often have underlayments consisting of built-up layers of roofing felt and hot-mopped asphalt, to provide an extra measure of waterproofing.

Most sloping roofs are covered with overlapping layers of shingles, and are produced from a variety of materials including, asphalt, wood, or tile. The principle underlying the function of the shingle roof is simple: to shed water that falls on the sloping roof by directing the water over layer upon layer of lapped shingle material until it goes over the side and falls to the ground.

Clay has been a popular choice of tile material in certain regions of the country including the West, the Southwest, and Florida, due to its visual appeal and durability. Furthermore, with the introduction of equally durable concrete tiles, made from a blend of cement, sand, and water, the use of roofing tiles has greatly increased in recent years. Because they are extruded, concrete tiles can be manufactured in a variety of shapes including: flat, ribbed, S-shaped, and even textured to resemble wood. Typically, these tiles measure 12 by 17 inches and are approximately ½ inch thick. In addition, the tiles incorporate at least one hole for fastening to the underlying subroof. Typically, the fastening hole is located near the top edge, at the tile "pan", or low point, of an S-shaped tile.

To achieve the desired overlapping configuration, tile is first installed along the roof edge, or eave, then successive layers are installed above, overlapping the previously installed row by approximately 3 inches. This sequence is repeated until the roof is substantially covered, at which point specially formed accessory tiles are installed to cap the remaining ridges.

Typically, roofing tiles are secured to the underlying subroof either by wiring, nailing, or in some instances with screws. While securing roofing tiles in this manner may prove adequate for certain regions of the country, it has been generally considered inadequate for regions subject to high winds accompanied by tornados and hurricanes. For example, when Hurricane Andrew struck South Florida in 1992, thousands of homes were damaged by high winds that stripped roof tops of protective tile covering. As a result, much effort has been directed to strengthening the means by which tile are fastened to the subroof.

One such device that has proven useful in holding down roof tile under high wind loading is commonly called a "hurricane clip". These clips are strap type locking fasteners which are nailed directly to the subroof and clip on to the side edge of each tile thereby providing a second holding point for securing the tile in place. Hurricane clips thus hold the lower tile end, or "nose", thereby preventing the nose from lifting in high winds. While hurricane clips have proven effective in reducing tile loss in high winds, they are often difficult and time consuming to install. In addition, conventional hurricane clips may compromise the water tight integrity of the subroof since the clips must be fastened to the sheathing with nails, thus significantly increasing the number of required subroof penetrations.

An example of such a device is disclosed in U.S. Pat. No. 4,182,090, issued to Aarons, a roof tile fastening clip, having a hook shaped configuration at one end and a nail incorporated at the opposite foot end, for securing tile to a batten. This configuration, however, requires additional fasteners for fixing the clips to the subroof. As a result, additional and undesirable subroof penetrations are required further compromising the watertight integrity of the underlying subroof and increasing installation time.

Similarly, U.S. Pat. No. 4,914,885, issued to Baker et al, discloses an improved roofing tile having an optional cutout provided on an overlying flange thereby permitting an underlying tile to be held with a hurricane clip on the underlying tile flange. The hurricane clip disclosed by Baker, however, also requires subroof penetrations, in addition to those required to fasten the tile, for securing the clip. In addition, Baker teaches the use of specially fabricated roofing tile incorporating a special cutout for accommodating the clip thus limiting its industry acceptance.

U.S. Pat. No. 4,314,433, issued to Hulcombe, which discloses a hurricane clip for use with generally S-shaped tile. Specifically, Hulcombe discloses a method and apparatus for fixing roofing tiles to a roof structure using a roofing tile fixing clip for securing overlapping roofing tiles to the roofing structure. The clip structure, however, is comprised of a generally C-shaped clip having a foot designed to engage a fastener securing a tile, at the roll, to an underlying batten, whereby the clip can then engage an overlapping tile edge. The Hulcombe clip, however, must be fastened to the tile hip thus requiring the use of battens. This arrangement is not suitable, however, for tiles that are configured to be fastened at the tile pan, and that do not require the use of battens.

In addition, a number of other disclosed inventions are directed toward highly specialized fasteners and clips for a variety of surface coverings have also failed to gain widespread industry acceptance. For example, U.S. Pat. No. 5,074,093, issued to Meadows, discloses unique OVERLAPPING ARCHITECTURAL TILES each including a locking ridge for engaging and securing an adjacent panel. U.S. Pat. No. 2,325,124, issued to Gardner, discloses a WEATHER SURFACE COVERING using a special clip to form an arrangement whereby roofing sheets are fastened to sheathing such that no exposed nail holes are present. U.S. Pat. No. 1,775,778, issued to Papalas, discloses a LOCKING STRIP FOR CORRUGATED METAL SHEETS for pressing the edges of the sheet seams together thereby holding said edges against movement. U.S. Pat. No. 1,566,415, issued to Miller, discloses a specialized ROOFING SHINGLE incorporating a retaining device having an extending edge portion for securing an adjacent shingle. All of the aforementioned specialized fastening means are specifically directed toward customized shingles and siding, however, and do not address retaining conventional shingles.

Therefore, there exists a need for a roofing tile hurricane clip for preventing the nose of an overlapping tile from lifting in high winds whereby the clip, and tile upon which said clip is mounted, are secured proximate the upper mounting tile pan edge by a common fastener. It is, therefore, to the effective resolution of the aforementioned problems and shortcomings that the present invention is directed.

SUMMARY OF THE INVENTION

The present invention is directed toward a roofing tile hurricane clip for preventing the nose of an overlapping tile from lifting in high winds whereby the clip, and tile upon which the clip is mounted, are secured proximate the upper mounting tile pan edge by a common fastener. The invention comprises a clip body having a first, fastening, end and a second generally C-shaped, end for engaging the lower side edge of an overlapping tile.

The fastening end is structured to conform to the tile pan, and incorporates a slotted aperture for accommodating a fastener. The clip is secured when the mounting tile is anchored to the subroof by first aligning the clip fastening aperture with the tile aperture existing on the upper tile pan section, then inserting a conventional fastener such as a nail therethrough such that the nail fastener penetrates the subroof thereby securing both the tile and the clip. The clip fastening end functions as a washer to insure that the anchoring fastener cannot pass through the body of the tile and therefore maintains a tight fit. Furthermore, the clip body extends laterally, conforming to the mounting tile roll curvature such that the C-shaped end is positioned on the tile roll for engaging the lower side edge of an overlapping tile. The clip of the instant invention is preferably fabricated from steel so as to resist upward forces caused by high winds. The instant invention contemplates clips having a variety of dimensions to conform to a variety of commonly shaped roofing tiles. Preferably, all embodiments are fabricated from galvanized steel, mount as previously described and anchor the lower side edge of one tile to an underlapping tile in a similar manner.

Thus, use of the instant invention reduces installation labor over existing roof tile clips since the clip is installed concurrently with the tile fastening procedure. In addition, the instant invention provides improved "uplift" resistance over the prior art since the clip is spring like and thus will give slightly rather than fail altogether when subjected to forces caused by sudden wind gusts.

In accordance with the instant invention, it is an object thereof to provide an improved hurricane clip for improving the ability of roofing tile to withstand high wind conditions.

It is a further object of the present invention to provide an improved hurricane clip that can be installed without the need for additional fasteners or subroof penetrations.

Still another object of the present invention is to provide a roofing tile hurricane clip that is resilient.

A further object of the present invention is to provide a roofing tile hurricane clip that acts as a washer thereby insuring lasting tightness between the fastener and the tile.

Yet another object of the present invention is to provide a low cost hurricane clip that is efficient to fabricate and install.

A further object of the present invention is to provide a roofing tile clip which remains in place and re-clips a replacement tile in the event the original tile is defective or otherwise must be replaced.

In accordance with these and other objects which will become apparent hereinafter, the instant invention will now be described with particular reference to the accompanying drawings.

BRIEF DESCRIPTION OF THE DRAWINGS

FIG. 5 is a partial exploded, partial cutaway, view of a roofing tile assembly incorporating the instant invention.

FIG. 6 depicts an installed roofing tile assembly incorporating the instant invention.

DESCRIPTION OF THE PREFERRED EMBODIMENTS

Figure 1:
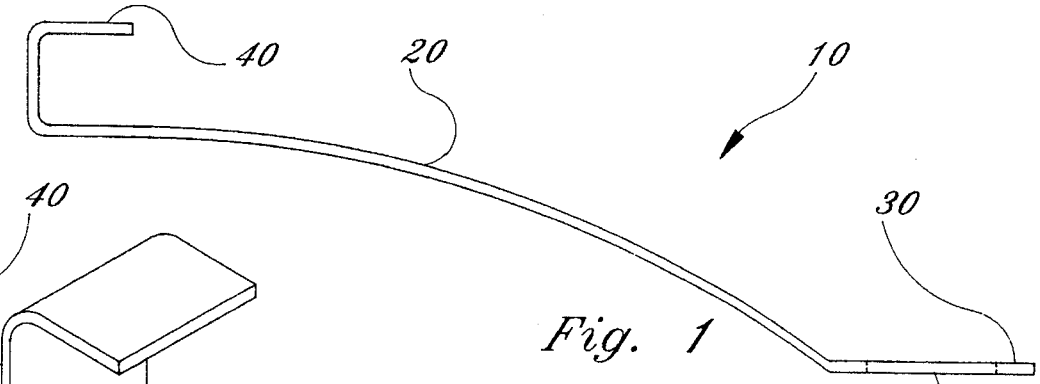
FIG. 1 is a side elevational view of a preferred embodiment of the instant invention.
Figure 2:
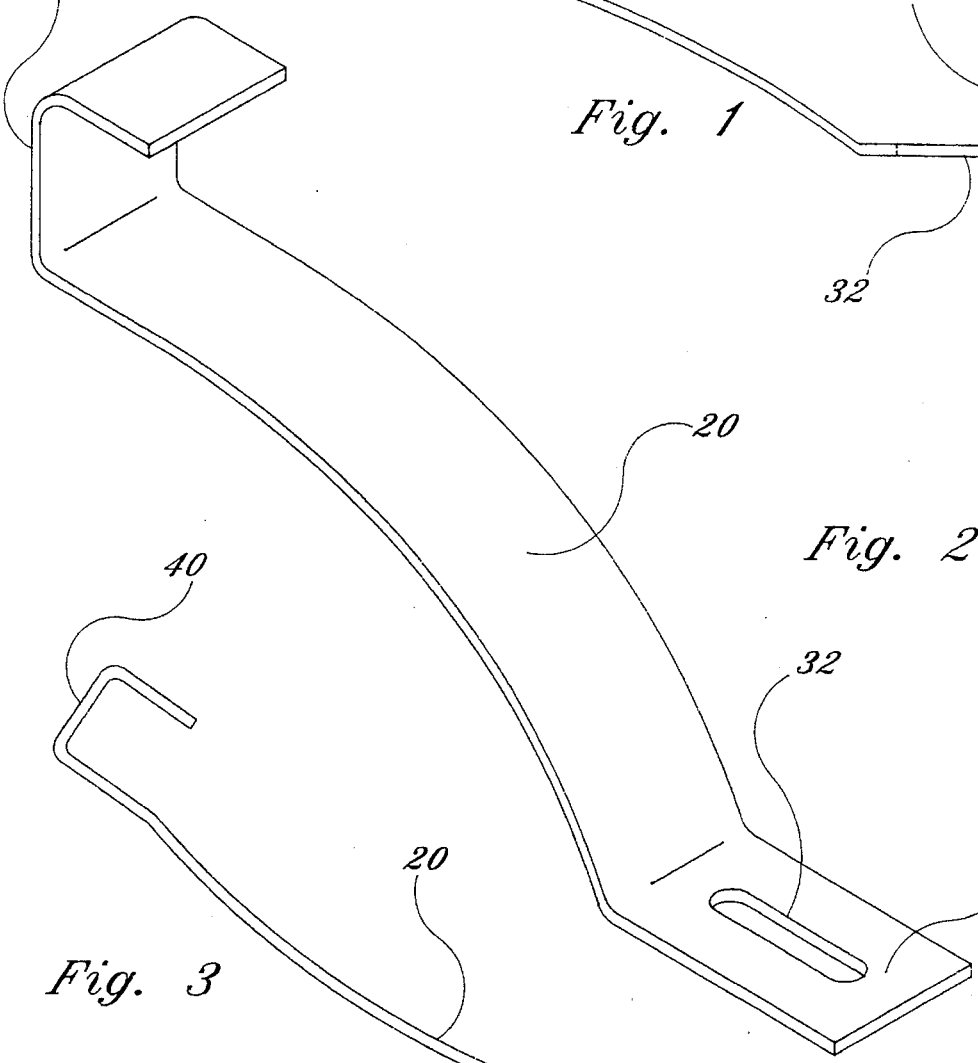
FIG. 2 is a perspective view of a preferred embodiment of the instant invention.

Turning now to the drawings, FIGS. 1 and 2 depict a preferred embodiment of the roofing tile hurricane clip of the instant invention, generally designated 10. Clip 10 is fabricated from steel, or any other suitable material of sufficient strength and rigidity, but exhibiting resilient characteristics, to enable clip 10 to withstand the lifting forces experienced by roofing tiles in high winds. The clip comprises a contoured mid-body portion 20 having a fastening end 30 and a C-shaped retaining end 40. Fastening end 30 incorporates an elongated or slotted aperture 32 for accommodating a conventional fastener therein. Aperture 32 is typically formed by punching such that excess material projects downward for assisting an installer in aligning aperture 32 with a corresponding tile aperture. Slotted aperture 32 functions to allow adjustment of clip 10 for initially securing an overlapping tile, or for disengaging clip 10 to facilitate the replacement of a defective or damaged overlapping tile. Retaining end 40 comprises a generally C-shaped configuration for attaching to the lower side edge of an overlapping tile. Additional embodiments are depicted in FIGS. 3, 4, and 9–11.

Figure 3:
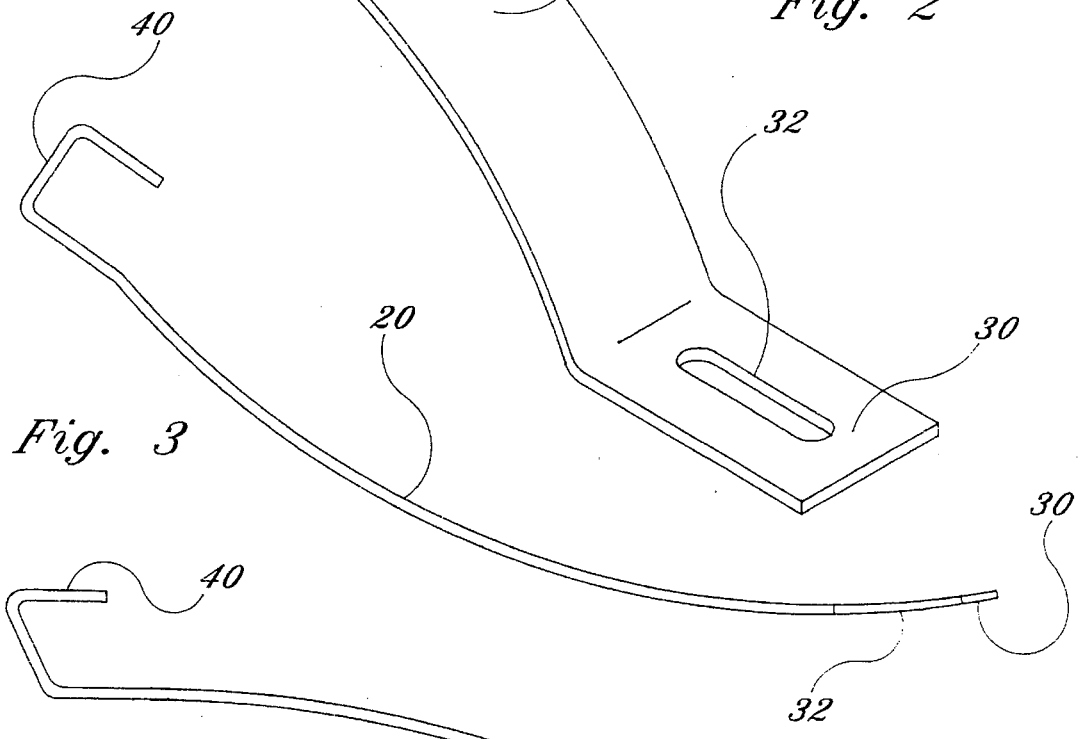
FIG. 3 depicts an alternate embodiment of the instant invention for use with a common tile configuration, in side elevation.
Figure 4:
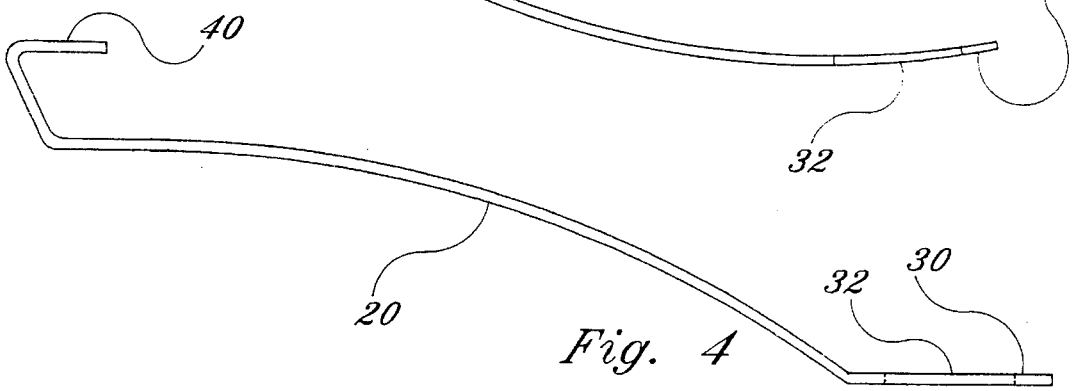
FIG. 4 depicts another alternate embodiment of the instant invention for use with another common tile configuration, in side elevation.

Body 20 is formed to conform generally to the shape of tile upon which the clip 10 is mounted. The instant invention, therefore, contemplates a variety of clip configurations for use with specific sizes and shapes of roofing tiles. FIGS. 3 and 4 depict alternate embodiments for use with different tile profiles.

Turning now to FIGS. 5 and 6, a roofing assembly is depicted. Typically, plywood sheathing 50 provides a nailing base for the roof surface. The underlayment 60, consisting of one or more layers, is sandwiched between the sheathing and the roof surface and usually consists of roofing felt, a thick, fibrous mat that has been saturated and coated with asphalt.

Upper roofing tile 70*a* and lower roofing tile 70*b* are depicted in a typical overlapping configuration. In a typical installation a row of tile is fastened along the bottom edge or low point of the roof structure, as depicted by tiles 70*b*. Tiles 70*b* are positioned adjacent one another such that the tile edges 78 are in mating engagement. The tiles are typically fastened by inserting a fastener through tile aperture 76, located proximate the upper tile edge, such that the tile is anchored to the subroof 50. Fasteners commonly used include roofing nails, staples, and to a lesser extent screws. When the lower tile row 70*b* is installed, additional tiles 70*a* are installed in an overlapping configuration as best depicted in FIG. 5. Tiles 70*a* are installed such that the lower tile edge overlaps the previously installed lower tiles 70*b* by several inches whereby each upper tile 70*a* extends past the fastening aperture 76 existing on each lower tile thereby completely covering apertures 76. As a result, water draining downwardly is prevented from leaking through the tile apertures 76, and the water tight integrity of the roofing assembly is insured.

Figure 7:
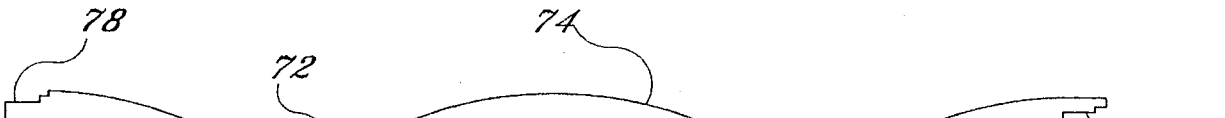
FIG. 7 is a side elevational view of a roofing tile.

FIG. 5 depicts the instant invention 10 in combination with overlapping roofing tiles 70*a* and 70*b*. As described, a lower roofing tile 70*b* is first set in a proper position on top of underlayment 60, supported by previously installed subroof 50 as known in the art. As best seen in FIG. 7, each tile 70 has a substantially flat section, referred to as the tile pan, and designated 72; and an arcuate raised section, referred to as the tile roll, designated 74, and a notched tile edge 78. Tile pan 72 incorporates an aperture 76, located proximate the upper tile edge, for accommodating a fastener therein for securing the tile to the underlying plywood sheathing 50.

The instant invention contemplates installing each tile by aligning tile retaining clip aperture 32 with tile aperture 76, such that the curvature of clip mid-body portion 20 conforms to tile roll 74, then fastening the tile 70 to sheathing 50 with a fastener 80 in a conventional manner such that fastener 80 is disposed through apertures 32 and 76 thereby securing both tile 70 and clip 10 to the subroof. This procedure is repeated, as previously described, and additional tiles are secured in adjacent formation until the lower tile row is complete.

An adjacent tile row is next installed in a similar manner such that each upper tile 70*a* overlaps the upper edge of the previously installed lower tile 70*b*. Upper tile 70*a* is installed such that C-shaped retaining clip end 40 engages the lower portion of the upper tile 70*a* thereby anchoring the lower edge of the upper tile, or tile nose, from significantly lifting.

Figure 8:
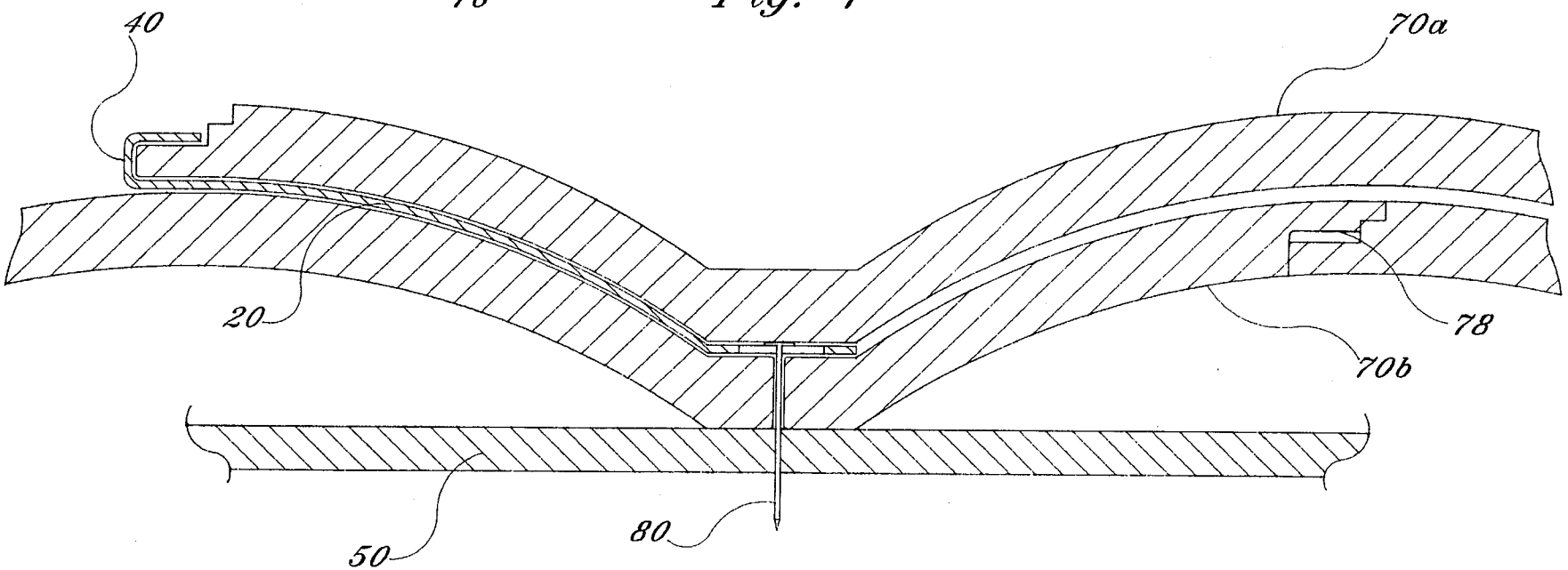
FIG. 8 is a cross-sectional elevational view of the instant invention installed.
Figure 9:
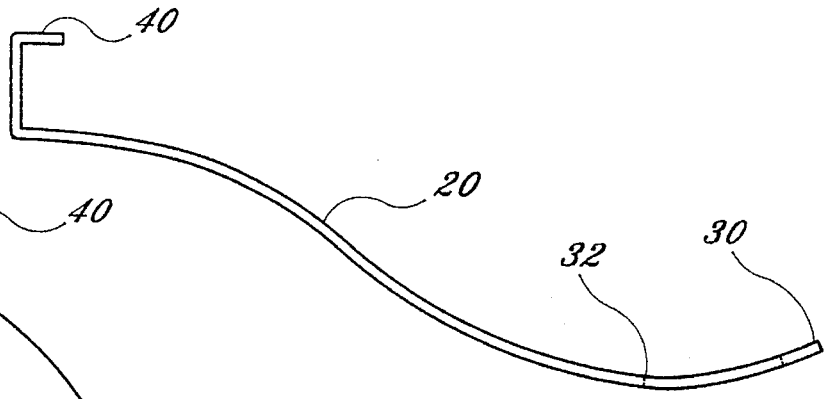
FIG. 9 is an alternate embodiment of the instant invention for use with another common tile configuration, in side elevation.
Figure 9A:
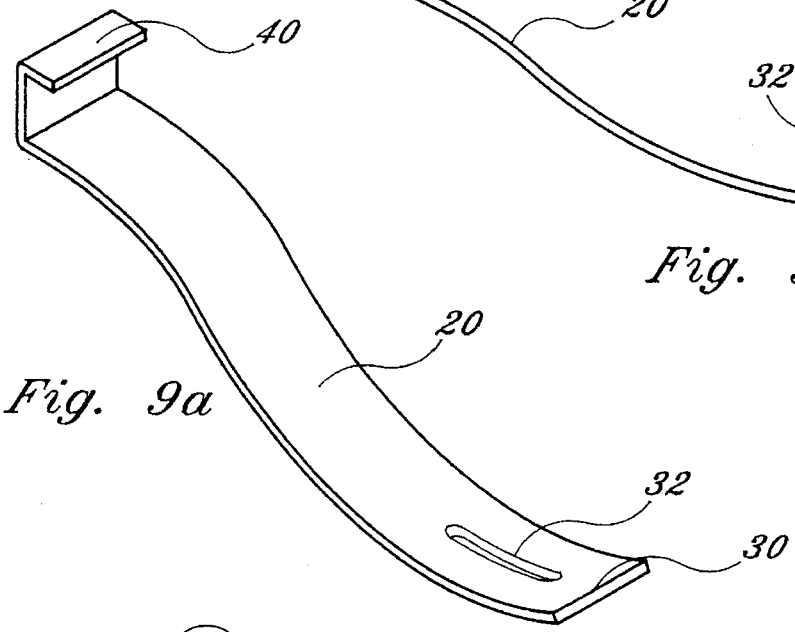
FIG. 9*a* is a perspective view of the embodiment depicted in FIG. 9.
Figure 10:
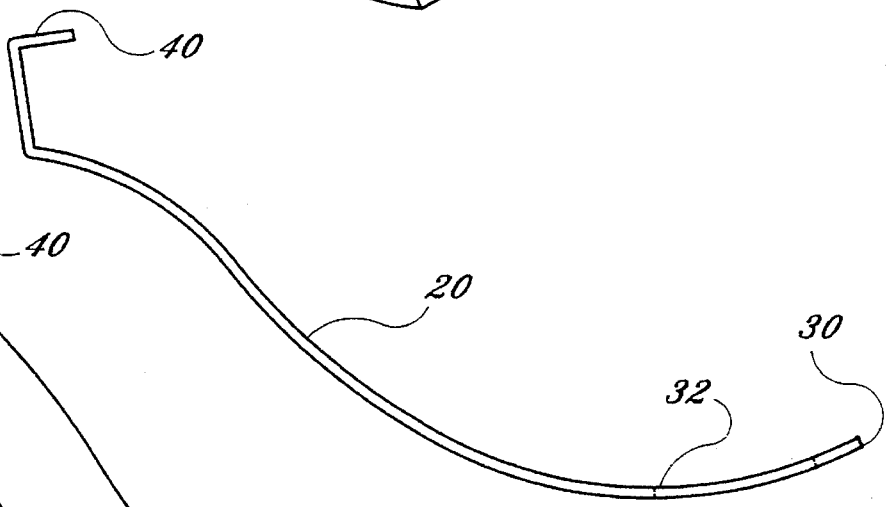
FIG. 10 is an alternate embodiment of the instant invention for use with another common tile configuration, in side elevation.
Figure 10A:
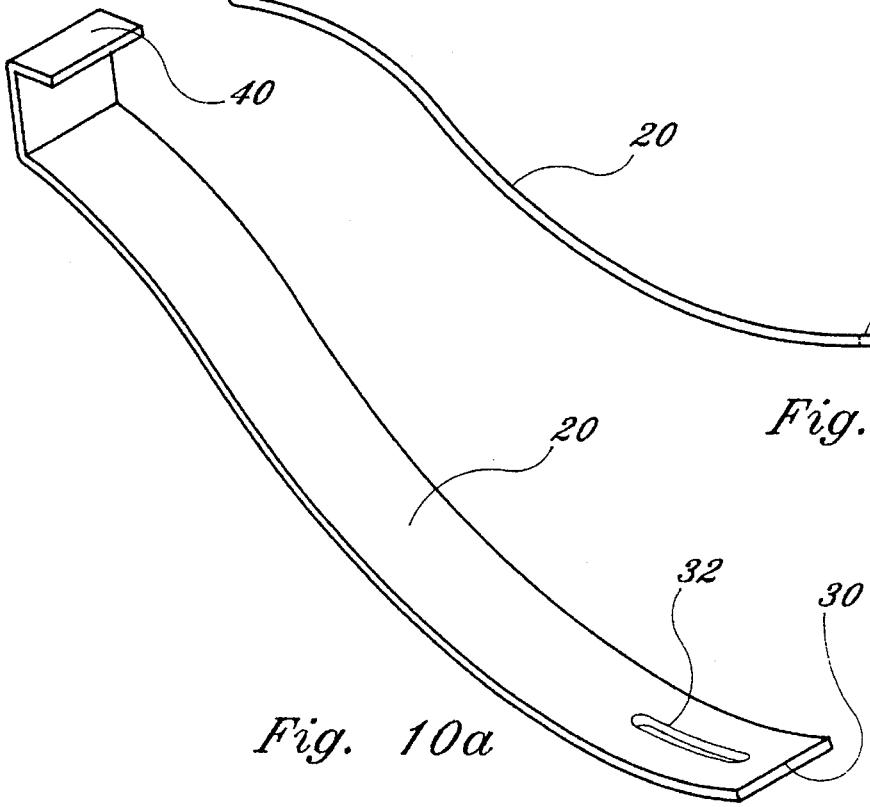
FIG. 10*a* is a perspective view of the embodiment depicted in FIG. 10.
Figure 11:
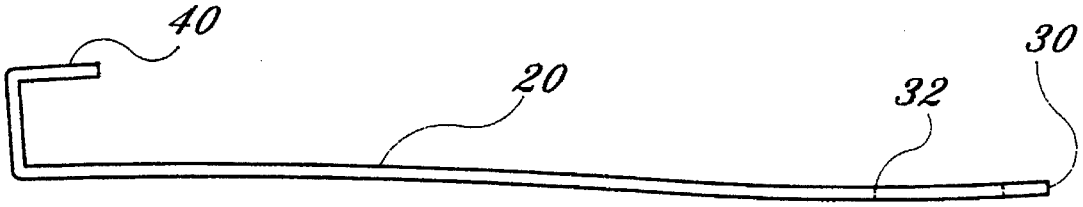
FIG. 11 is an alternate embodiment of the instant invention for use with another common tile configuration, in side elevation.
Figure 11A:
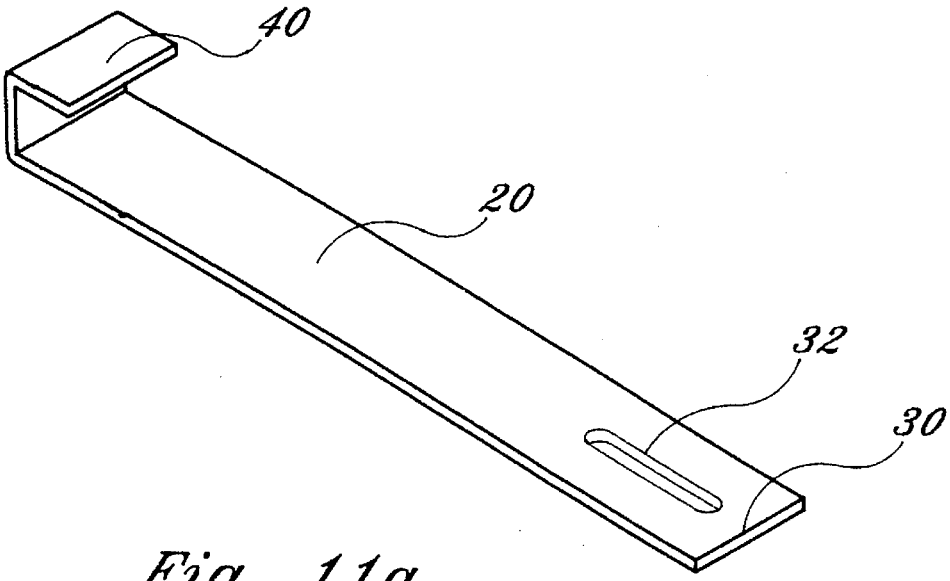
FIG. 11*a* is a perspective view of the embodiment depicted in FIG. 11.

When installed, the C-shaped tile clip 40 engages the side edge 78 of an overlapping tile 70*a* as best seen in FIGS. 6 and 8. When, as in high wind conditions, overlapping tile 70*a* experiences lifting forces, the instant invention 10 applies a counter force on the tile edge 78 thereby retaining tile 70*a* securely to the roof structure. The instant invention 10 is fabricated to fit the particular notch configuration, indicated by 78 in FIG. 7, existing at the edge of a particular style of tile. As a result, when installed, the instant invention 10 conforms to the tile shape and does not distort the normal interface between tiles in any way thereby maintaining the watertight integrity of the roof structure. Another advantage realized is that the instant invention and supporting tile are fastened to the subroof with a common fastener passing through the tile pan aperture thereby eliminating the need for additional unwanted subroof penetrations.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A roof tile anchoring clip for securing overlapping roof tiles to a roof structure, said roof tiles comprising a pan section defining a tile aperture, an arcuate raised section and a notched tile edge, said clip comprising:

an elongated retaining clip body, said clip body having a fastening end defining a fastening aperture and a tile retaining end defining a C-shaped means for engaging the notched tile edge, said clip body further having a curved mid-body portion comprising a continuous elongated arc formed between said fastening end and said tile retaining end for providing resilient variable resistance, said mid-body portion adapted to conform to the arcuate raised section, said mid-body portion adapted to extend from said pan section to at least an apex of said arcuate raised section;

wherein, in use, said mid-body portion acts as a resilient variable resistance arm that increases resistance as said roofing tiles are forced upward from said roof structure under wind-induced loading.

2. A roof tile anchoring clip according to claim 1, wherein said retaining clip body is integrally constructed of steel.

3. A roof tile anchoring clip for securing overlapping roof tiles to a roof structure, said roof tiles comprising a pan section defining a tile aperture, an arcuate raised section extending from the pan section and a notched tile edge opposite the arcuate raised section, said clip comprising:

an elongated retaining clip body, said clip body having a fastening end defining a fastening aperture and a C-shaped tile retaining end for engaging said notched tile edge, said clip body further having a curved mid-body portion comprising a continuous elongated flexible arc formed between said fastening end and said tile retaining end for providing resilient variable resistance when the roof tile is lifted, said mid-body portion adapted to conform to at least a portion of said arcuate raised section, said clip projecting upward at an angle from said fastening end toward said retaining end;

wherein, in use, a fastener is inserted through said fastening aperture and said tile aperture into said roof structure such that said clip body is concealed between said roofing tiles, said mid-body portion acting as a resilient variable resistance arm that increases resistance as said roofing tiles are forced normally upward from said roof structure.

4. A roof tile anchoring clip according to claim 3, wherein said retaining clip body is integrally constructed of steel.

5. A roof tile anchoring clip for securing overlapping roof tiles to a roof structure, said roof tiles each having at least one raised arcuate section, a generally planar pan section connecting adjacent raised arcuate sections and defining a tile aperture, and opposing side edges individually defined by said raised arcuate section, said clip comprising:

an elongated clip body having a lower, fastening, end and an upper, C-shaped tile retaining end for anchoring a selected roof tile of the overlapping tiles;

said lower end defining a fastener aperture adapted for aligning with the tile aperture of the planar pan section of one of said roof tiles positioned below the selected roof tile for receiving a fastener to anchor said roof tile to said roofing structure;

a flexible arcuate mid-body section defined by said clip body and comprising a continuous elongated arc integrally joining said fastening end and said tile retaining end, said arcuate mid-body section providing a resilient variable resistance arm that exerts an increasing downward force on one of the overlaying roof tiles as the roof tiles are forced upward away from said roof structure under wind-loading conditions; and said C-shaped tile retaining end facing inward over a portion of said arcuate mid-body section for engaging one of the opposing side edges of an overlapping roof tile to secure the overlapping roofing tile with said roofing tile such that said clip body is concealed from external visual inspection.

6. A roof tile anchoring clip according to claim 5, wherein said fastening end is planar.

7. A roof tile anchoring clip according to claim 5, wherein said anchoring clip is steel.

* * * * *